US005836818A

United States Patent [19]

Jones et al.

[11] Patent Number: 5,836,818

[45] Date of Patent: Nov. 17, 1998

[54] COIN ACCEPTOR INCLUDING MULTI-STATE VISUAL INDICATOR APPARATUS AND METHOD

[75] Inventors: Daniel A. Jones, Las Vegas, Nev.; Terry Adams, Coconut Creek, Fla.; Mark W. Duron, Ft. Lauderdale, Fla.; Yosef Har-Nov, Deerfield Springs, Fla.; John Stitt, Coral Springs, Fla.; James P. Suttle, Las Vegas, Nev.

[73] Assignee: Progressive Games, Inc., Ft. Lauderdale, Fla.

[21] Appl. No.: 408,267

[22] Filed: Mar. 20, 1995

Related U.S. Application Data

[63] Continuation-in-part of Ser. No. 328,498, Oct. 25, 1994, and Ser. No. 337,661, Nov. 9, 1994, each is a division of Ser. No.40,925, Mar. 31, 1993, Pat. No. 5,364,104, which is a division of Ser. No. 800,631, Nov. 27, 1991, Pat. No. 5,288,077, which is a continuation-in-part of Ser. No. 361, 276, Jun. 5, 1989, Pat. No. 5,078,405, which is a division of Ser. No. 214,934, Jul. 5, 1988, Pat. No. 4,861,041, which is a continuation-in-part of Ser. No. 182,374, Apr. 18, 1988, Pat. No. 4,836,553.

[51] Int. Cl.[6] ..... A63F 1/00; A63F 9/24

[52] U.S. Cl. ..... 463/29; 273/309; 463/12; 463/13; 463/25

[58] Field of Search ..... 273/292, 309, 273/138 A, 143 R, 274, 138.1; 463/25, 29, 12, 13

[56] References Cited

U.S. PATENT DOCUMENTS

| | | | |
|---|---|---|---|
| D. 105,610 | 8/1937 | Posey | D6/618 |
| D. 118,451 | 8/1940 | Radford | D21/26 |
| D. 183,007 | 6/1958 | Lord | D21/26 |

(List continued on next page.)

FOREIGN PATENT DOCUMENTS

| | | |
|---|---|---|
| 621599 | 4/1989 | Australia . |
| 628044 | 4/1989 | Australia . |
| 96049 | 4/1989 | Australia . |

(List continued on next page.)

OTHER PUBLICATIONS

Winning Gamer, Issue #5, Feb. 1985, Pi Yee Press, LaJolla, CA.

Winning Gamer, Issue #6, Mar. 1985, Pi Yee Press, LaJolla, CA.

Winning Gamer, Issue #15, Dec. 1985, Pi Yee Press, LaJolla, CA.

Winning Gamer, Issue #19, Apr. 1986, Pi Yee Press, LaJolla, CA.

Winning Gamer, Issue #20, May 1986, Pi Yee Press, LaJolla, CA.

Winning Gamer, Issue #21, Jun. 1986, Pi Yee Press, LaJolla, CA.

Affidavit of John F. Acres, Oct. 4, 1993.

(List continued on next page.)

*Primary Examiner*—Benjamin H. Layno

[57] ABSTRACT

A coin acceptor for use in accepting coins, paper currency, tokens, or magnetic cards includes a multi-state visual display for indicating the condition of the coin acceptor or an attached device. The coin acceptor finds application in connection with gambling devices including video poker games and slot machines, as well as with vending machines, arcade games, automated teller machines, and other similarly actuated devices and machines. In a preferred embodiment, the coin acceptor finds application in connection with a progressive jackpot component for a live casino table game and includes a visual display having three different states. In a first state, corresponding to jackpot wager attract or invitation, a plurality of LEDs surrounding a token slot flash sequentially to form a traveling pattern around the slot. In a second state, corresponding to jackpot wager placement, the LEDs flash simultaneously. In a third state, corresponding to jackpot wager acceptance, the LEDs remain continuously illuminated.

16 Claims, 7 Drawing Sheets

U.S. PATENT DOCUMENTS

| | | | |
|---|---|---|---|
| D. 213,891 | 4/1969 | Schultz | D21/32 |
| D. 220,635 | 5/1971 | Boyer et al. | D21/30 |
| D. 245,717 | 9/1977 | Jessie | D21/32 |
| D. 263,975 | 4/1982 | Quiroga et al. | D21/37 |
| D. 311,474 | 10/1990 | Hoffman | D6/618 |
| 1,238,736 | 9/1917 | Barrett | 953/18 |
| 1,527,929 | 6/1925 | Simons | 273/139 |
| 1,763,476 | 6/1930 | Morris | 273/309 |
| 1,970,876 | 4/1934 | Anderson | 273/309 |
| 2,008,829 | 10/1935 | Israel | 273/148 A |
| 2,199,745 | 5/1940 | Harris | 273/309 |
| 3,011,789 | 12/1961 | Eliassen et al. | 273/287 |
| 3,269,503 | 8/1966 | Foster | 463/26 |
| 3,556,531 | 1/1971 | Elder | 273/143 R |
| 3,663,021 | 5/1972 | Whippo | 273/274 |
| 3,667,757 | 6/1972 | Holmberg | 273/274 |
| 3,689,071 | 9/1972 | Kucera | 273/281 |
| 3,796,433 | 3/1974 | Fraley et al. | 463/12 |
| 3,825,255 | 7/1974 | Kennard et al. | 273/139 |
| 3,874,671 | 4/1975 | Smith | 273/254 |
| 3,876,208 | 4/1975 | Wachtler et al. | 463/13 |
| 3,998,462 | 12/1976 | Goott | 273/237 |
| 4,063,680 | 12/1977 | Leo | 232/1 B |
| 4,099,722 | 7/1978 | Rodesch et al. | 273/143 R |
| 4,232,866 | 11/1980 | Pennachio | 273/374 |
| 4,302,012 | 11/1981 | Di Giovanni et al. | 273/148 R |
| 4,305,586 | 12/1981 | Richards | 273/274 |
| 4,364,567 | 12/1982 | Goott | 273/237 |
| 4,397,469 | 8/1983 | Carter, III | 273/149 R |
| 4,518,001 | 5/1985 | Branham | 133/5 R |
| 4,531,187 | 7/1985 | Uhland | 364/412 |
| 4,575,085 | 3/1986 | Ollington | 273/138.1 |
| 4,614,342 | 9/1986 | Takashima | 463/11 |
| 4,624,459 | 11/1986 | Kaufman | 463/20 |
| 4,648,604 | 3/1987 | Horan | 273/292 |
| 4,651,997 | 3/1987 | Wood | 273/274 |
| 4,700,948 | 10/1987 | Okada | 273/143 R |
| 4,721,307 | 1/1988 | Okada | 273/143 R |
| 4,743,022 | 5/1988 | Wood | 463/13 |
| 4,756,531 | 7/1988 | DiRe, et al. | 463/18 |
| 4,759,549 | 7/1988 | Beckwith | 273/274 |
| 4,760,527 | 7/1988 | Sidley | 364/274 |
| 4,813,675 | 3/1989 | Greenwood | 463/46 |
| 4,836,546 | 6/1989 | DiRe, et al. | 463/18 |
| 4,836,553 | 6/1989 | Suttle et al. | 273/292 |
| 4,837,728 | 6/1989 | Barrie et al. | 273/412 |
| 4,861,041 | 8/1989 | Jones et al. | 273/292 |
| 4,948,134 | 8/1990 | Suttle et al. | 463/13 |
| 4,964,638 | 10/1990 | Ishida | 463/27 |
| 5,007,519 | 4/1991 | Mercurio | 194/230 |
| 5,019,973 | 5/1991 | Wilcox, et al. | 463/13 |
| 5,022,653 | 6/1991 | Suttle et al. | 463/13 |
| 5,042,818 | 8/1991 | Weingardt | 273/292 |
| 5,078,405 | 1/1992 | Jones et al. | 273/309 |
| 5,098,107 | 3/1992 | Boylan et al. | 273/292 |
| 5,112,060 | 5/1992 | Jones | 273/309 |
| 5,154,429 | 10/1992 | Lavasseur | 273/292 |
| 5,167,413 | 12/1992 | Fulton | 463/13 |
| 5,248,142 | 9/1993 | Breeding | 273/138.1 |
| 5,249,800 | 10/1993 | Hilgendorft et al. | 463/27 |
| 5,257,810 | 11/1993 | Schorr et al. | 273/292 |
| 5,275,400 | 1/1994 | Weingardt et al. | 463/12 |
| 5,275,411 | 1/1994 | Breeding | 273/149 R |
| 5,277,424 | 1/1994 | Wilms | 463/12 |
| 5,288,077 | 2/1994 | Jones | 273/292 |
| 5,288,081 | 2/1994 | Breeding | 273/292 |
| 5,364,104 | 11/1994 | Jones et al. | 273/292 |
| 5,364,105 | 11/1994 | Jones | 273/292 |
| 5,374,067 | 12/1994 | Jones | 273/292 |
| 5,377,973 | 1/1995 | Jones | 463/12 |
| 5,377,994 | 1/1995 | Jones | 273/309 |
| 5,380,012 | 1/1995 | Jones | 273/292 |
| 5,382,025 | 1/1995 | Sklansky et al. | 273/292 |
| 5,393,067 | 2/1995 | Paulsen et al. | 273/292 |
| 5,417,430 | 5/1995 | Breeding | 273/292 |
| 5,437,462 | 8/1995 | Breeding | 273/292 |

FOREIGN PATENT DOCUMENTS

| | | | |
|---|---|---|---|
| 1334983 | 3/1995 | Canada . | |
| 1335381 | 4/1995 | Canada . | |
| 4792 | 6/1991 | Dominican Rep. . | |
| 4793 | 6/1991 | Dominican Rep. . | |
| 4825 | 3/1993 | Dominican Rep. . | |
| 4999 | 8/1993 | Dominican Rep. . | |
| 2830216 | 1/1980 | Germany . | |
| 3003376 | 8/1981 | Germany . | |
| 68909992 | 4/1989 | Germany . | |
| 0338644 | 4/1989 | Italy . | |
| 135187 | 6/1988 | Japan . | |
| 2083936 | 3/1982 | United Kingdom | 273/138 A |
| 2097570 | 4/1982 | United Kingdom . | |
| 2169736 | 7/1986 | United Kingdom . | |
| 2184029 | 6/1987 | United Kingdom . | |
| 9220417 | 11/1992 | WIPO . | |
| 9310869 | 6/1993 | WIPO . | |
| 9415684 | 7/1994 | WIPO . | |
| 9521665 | 8/1995 | WIPO . | |

OTHER PUBLICATIONS

Affidavit of William Randall Adams, Oct. 4, 1993.

Affidavit of Derell M. Johns, Nov. 19, 1993.

Affidavit of Terry Oliver, Nov. 22, 1993.

Affidavit of Nick Edward Greenwood, Nov. 23, 1993.

Affidavit of Michael Spencer Stone, Nov. 23, 1993.

Scarne, Scarne's Encyclopedia of Games, Harper & Row, N.Y., Copyright 1973, pp. 381, 383 and title pages.

Scarne, Scarne's Encyclopedia of Games, Harper & Row, N.Y. Copyright 1973, pp. 33–41 and title pages.

Scarne, Scarne's New Complete Guide to Gambling, Simon & Schuster, N.Y., Copyright 1961, pp. 440–445.

Scarne, Scarne's Encyclopedia of Card Games, Harper & Row, N.Y., Copyright 1983, pp. 299–383, and title pages.

W.B. Gibson, Hoyle's Modern Encyclopedia of Card Games, pp. 218–219, 369–370 (1974).

Casino Player, vol. IV, No. 12, Aug. 1993, "My Biggest Slot Jackpot", Stanford Wong.

Gaming Concepts, Inc. "Over/Under 13 Blackjack" brochure, 1988.

Casino Journal, vol. 8, No. 12, Dec. 1992, "Working Within The Systems: IGT's linked progressive programs take leap to the tables", pp. 10–15, 40, 41.

Casino Gaming, Sep. 1988, "Aruba Deals A New Game: Caribbean Stud Poker", pp. 12–13.

Casino Journal, vol. 8, No. 6, Jun. 1993, "So You Wanna Be A Gambler", pp. 1, 5.

Information Disclosure Statement, Apr. 7, 1988, Describing "Sklansky's Casino Poker and Video Poker".

Coin Hopper Model CH–500 and Model No. DH–750/U1 literature Asahi Seiko.

26 Jan., 1993 Statement of Grounds and Particulars, By John Huxley Ltd., In Opposition to Australian in Opposition to Australian Patent Application No. 628044.

State of New Jersey Casino Control Commission PRN 217205 Civil Action, IGT's Second Amended Petition for Authorization for the Implementation of the Game of Progressive 21, filed sometime after Aug. 4, 1992.

Review Journal, "Gamblers Take Chance at Million Dollar Payoff", by C. J. Boyer Winning Gamer, Issue #17, Feb. 1986, Pi Yee Press, LaJolla, CA.
Scarne, Scarne's Encyclopedia of Games, "Hold 'Em", Harper & Row Publishers, Copyright 1973, pp. 14–18, 26
Abercrinbue & Fitch, Play Hours, 1960, p. 11, Blackjack Towel.
Scarne, Scarne's Encyclopedia of Card Games, copyright date unknown, p. 288.
Jim Kilby'Declaration Under 37 C.F.R. § 1.132.
TXU 184,603, Mar. 30, 1985.
TX 2,568,066, Mar. 6, 1989.
Scarne, Scarne's Guide to Modern Poker, copyright unknown, pp. 40, 60–61.
Request for Reexamination, U.S. Patent No. 4,861,041; issued Aug. 29, 1989; Date of Service: Jun. 20, 1995, Sep. 2, 1993.
Request for Reexamination, U.S. Patent No. 5,288,077, issued Feb. 22, 1994; Date of Service May 26, 1995.
Request for Reexamination, U.S. Patent No. 5,364,105, issued Nov. 15, 1994; Date of Service May 26, 1995.
Asahi Seiko Catalog No. AV89C, Aug. 20, 1989, pp. 44,51 and Photograph "A".
Scarne, Scarne's Encyclopedia of Games, Copyright 1973, pp. 11,31, 440–445.
Declaration of I. Nelson Rose, dated Jan. 26, 1989.
Declaration of Don Clark, dated Feb. 2, 1989.
Declaration of Dennis Robie, dated Jan. 27, 1989.
Declaration of Mark A. Sincox, dated Feb. 7, 1989.
Declaration of John Edward Roethel, dated Feb. 7, 1989.
D&D Gaming Patents, Inc. v. Rio Properties, Inc., et al., Case No. CV–S–93–835–LDG–RLH; Defendants JFA Enterprises, Inc.'s and John F. Acre's Supplemental Responses to Plaintiff's Interrogatories Nos. 11–20; as Requested by Feb. 28, 1994 Letter From Plaintiff's Counsel; Supplemental Response to Interrogatory No. 19; admitted prior art.

COIN ACCEPTOR INCLUDING MULTI-STATE VISUAL INDICATOR APPARATUS AND METHOD

CROSS REFERENCE TO RELATED APPLICATIONS

This application is a continuation-in-part of application Ser. No. 08/328,498 filed Oct. 25, 1994 and application Ser. No. 08/337,661 filed Nov. 9, 1994; both of which are divisions of application Ser. No. 08/040,925 filed Mar. 31, 1993, and now U.S. Pat. No. 5,364,104; which is a division of application Ser. No. 07/800,631 filed Nov. 27, 1991 and now U.S. Pat. No. 5,288,077; which is a continuation-in-part of application Ser. No. 07/361,276, filed Jun. 5, 1989 and now U.S. Pat. No. 5,078,405; which is a division of application Ser. No. 07/214,934, filed Jul. 5, 1988 and now U.S. Pat. No. 4,861,041; which is a continuation-in-part of application Ser. No. 07/182,374, filed Apr. 18, 1988 and now U.S. Pat. No. 4,836,553. The entire disclosures of each of the above-listed applications and patents are hereby incorporated by reference herein.

BACKGROUND OF THE INVENTION

The present invention relates generally to coin acceptors of the type utilized to detect insertion or placement of coins, tokens, or magnetic cards in order to activate an associated device such as a gambling device, amusement device, vending machine, automated teller machines, or other similarly actuated machine or device. The instant invention more particularly pertains to a coin acceptor including a multi-state visual indicator operative to display different visual states corresponding to different conditions of the coin acceptor and/or associated device or machine.

In a preferred embodiment, the present invention provides an improved coin acceptor particularly adapted for use with an apparatus for providing a progressive jackpot component to a live casino table game, as disclosed in U.S. Pat. No. 5,078,405. U.S. Pat. No. 5,078,405 discloses a coin acceptor mounted at each player location of a live casino card gaming table of the type typically utilized in the play of Caribbean Stud (TM) Poker and Twenty-one. A wiring harness and associated circuitry electronically connect the coin acceptors to a progressive jackpot meter. When a player drops a coin into the coin acceptor, a controller illuminates a light at the player's location indicating participation by the player in the progressive jackpot. At the same time, a signal from the coin acceptor increments the progressive jackpot meter. Dealer activation of a lockout switch connected to the coin acceptors prevents a coin placed into any coin acceptor after the lockout switch has been pressed from turning on the associated light and from incrementing the meter. The lockout switch prevents late wagering after start of play of a particular hand. Manual activation of a reset switch by a casino dealer after a hand turns off the indicator lights on the gaming table and resets the apparatus for the next hand.

SUMMARY OF THE INVENTION

The present invention relates to a controllable interactive coin acceptor including a multi-state visual indicator operative to display different visual states dependent upon the condition of the coin acceptor and/or the associated device. The coin acceptor of the present invention may be employed in connection with a large number of different types of devices activated by placement or insertion of a token, paper currency, coin, or magnetic card. Examples of such devices include video poker machines, slot machines, arcade games, vending machines, automated teller machines, and the like.

Preferably, the coin acceptor pursuant to the invention includes a visual indicator operative to display at least three different visual states. In an example preferred embodiment, the coin acceptor includes a plurality of LEDs disposed to at least partially surround a coin slot or other receptor for a coin, token, etc. In a first visual state, the LEDs flash in sequence to produce the visual effect of a single travelling light circumscribing the coin slot. In a second visual state, the LEDs simultaneously flash on and off. In a third visual state, all of the LEDs remain continuously illuminated.

In the context of this invention, the term coin acceptor includes a device for accepting any tangible article, such as a token, actual currency including coinage or paper currency, a magnetically encoded card, such as a cash, debit or credit card, or with any other tangible article. Therefore the terms coin and token are used interchangeably in the context of this specification. Although the coin acceptor in the preferred embodiment includes a slot for insertion of a coin, the invention may be practiced in other alternative ways. For example, the slot may be replaced by a designated zone or spot including a sensor for detection of placement of a coin or token within a specified boundary.

In a particularly preferred embodiment of the invention, the coin acceptor of the present invention finds application in association with apparatus for providing a progressive jackpot component to a live casino table game, as disclosed in U.S. Pat. No. 5,078,405. In this apparatus, a player places an optional wager to participate in a progressive jackpot component of a live casino card game by inserting a gaming token into a coin acceptor disposed at the player's location at a live casino card table. In the apparatus disclosed in the '405 Patent, each coin acceptor includes a light automatically illuminated by control circuitry to indicate wager acceptance and player participation in the progressive jackpot. The inventive coin acceptor allows indication of three different conditions in association with this type of progressive jackpot apparatus: (1) attract or invite jackpot wager, (2) jackpot wager placed, and (3) jackpot wager accepted. In a first visual state of the coin acceptor of the present invention, LEDs at least partially surrounding a slot of the coin acceptor flash sequentially in an attract or invite mode to indicate to a player an opportunity to place a wager for the optional jackpot component. Upon initial wager placement, the token rests upon a solenoid rod blocking the token drop path, with the upper portion of the token protruding from the slot. Detection of the token by a first optical sensor disposed above the solenoid results in the display of a second visual state, in which all of the LEDs surrounding the slot flash on and off simultaneously to indicate wager placement. Upon dealer activation of a lockout switch, the solenoid rod retracts, allowing the token to fall downwardly by virtue of gravity past a second optical sensor. Upon detection of the token drop by the second optical sensor, all of the LEDs remain continuously illuminated in a third visual state to indicate wager acceptance. Dealer activation of a manual reset button returns the visual display to the first visual state for the next hand.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The invention will be described with reference to the accompanying drawings forming a part of the specification, in which like reference characters designate similar components, wherein.

DETAILED DESCRIPTION OF A PREFERRED EMBODIMENT

Figure 1:
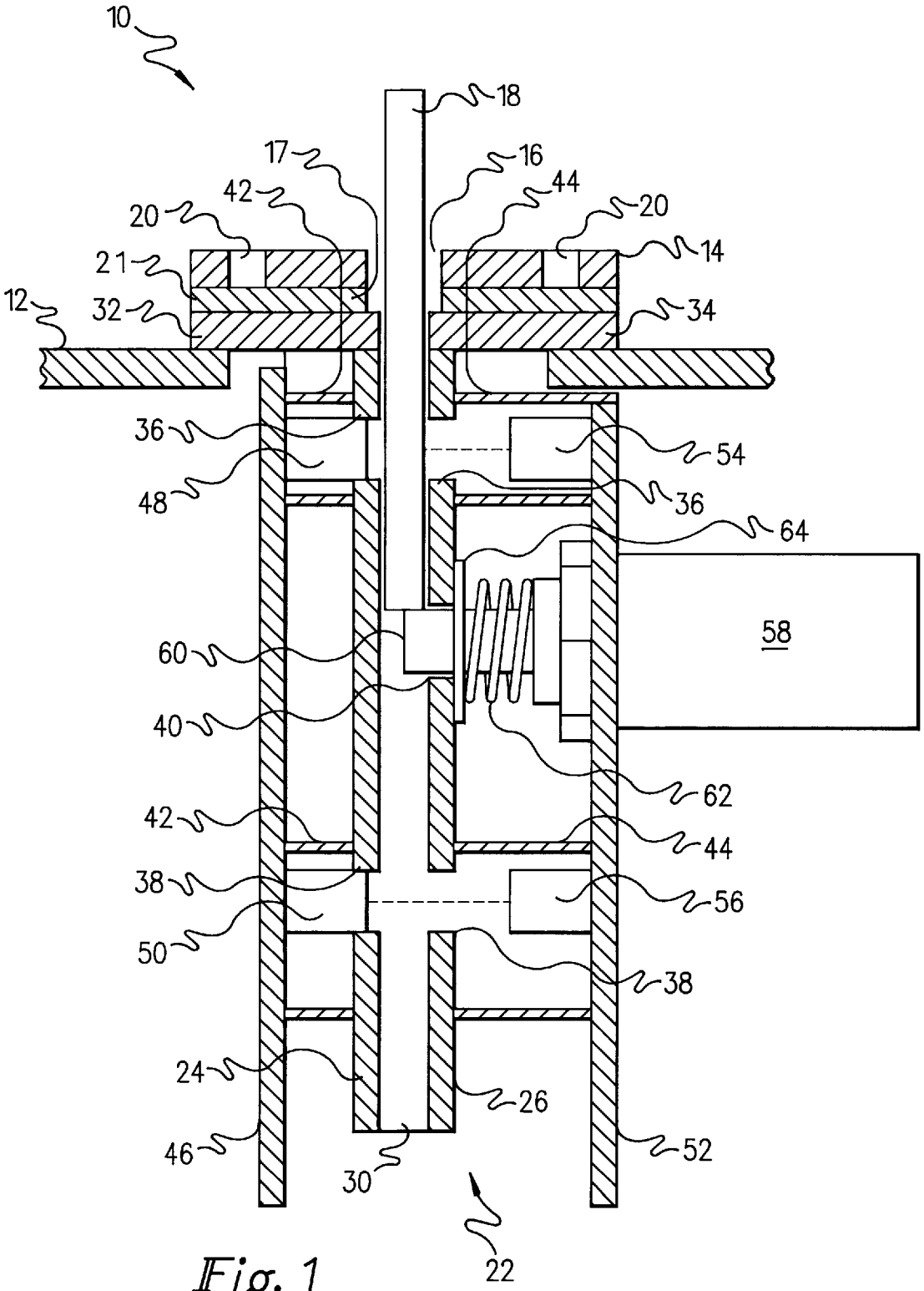
FIG. 1 illustrates a longitudinal cross-sectional view of components of a controllable interactive coin acceptor according to a preferred embodiment of the present invention.
Figure 2:
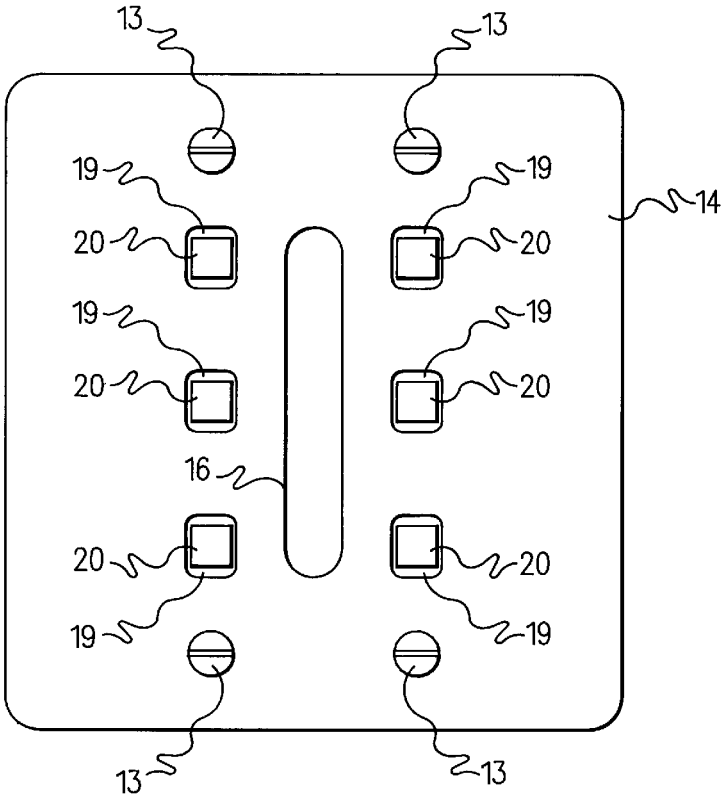
FIG. 2 illustrates a top plan view of a face plate of the coin acceptor of FIG. 1, depicting six LEDs forming a visual display.

FIG. 1 illustrates a longitudinal cross-sectional view showing a coin acceptor 10 according to a preferred embodiment of the present invention mounted to a surface 12 of a gaming table of the type utilized in casinos in connection with the play of live casino card games such as Caribbean Stud (TM) Poker or Twenty-One. Preferably, a coin acceptor 10 is disposed at each of a plurality of player locations spaced about the table in order to provide an optional progressive jackpot component, in the manner described in U.S. Pat. No. 5,078,405. With reference to FIGS. 1 and 2, the coin acceptor 10 includes a face plate 14 provided with a slot 16 dimensioned and disposed for insertion of a token 18. The face plate 14 includes a plurality of openings 19 disposed to at least partially surround the slot 16. The openings 19 form display windows for light sources, such as LEDs 20. The LEDs 20 form a visual display operative to display three different visual states, in a manner described in detail hereinafter.

Figure 3:
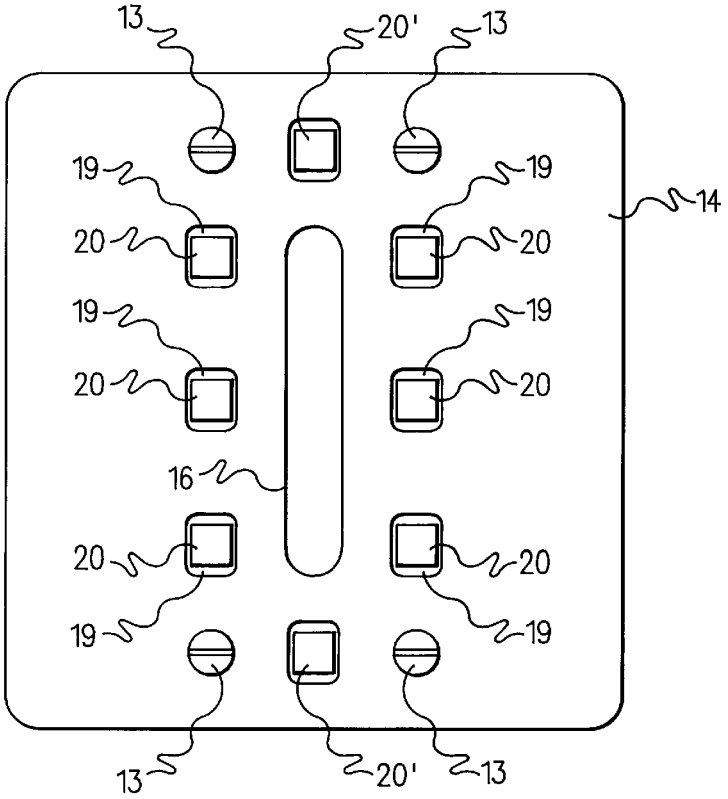
FIG. 3 illustrates a top plan view of an alternate face plate design, in which eight LEDs substantially surround a coin slot portion of the coin acceptor.

In an alternative embodiment shown in FIG. 3, two additional LEDs 20' disposed at opposite ends of the slot 16 cooperate with the six LEDs 20 to form a substantially continuous path surrounding the coin slot 16. The number, arrangement, and spacing of the elements forming the visual display can be varied within the scope of the instant invention. As an alternative to LEDs, other light sources such as bulbs or tubes may be provided. LCD type display elements may also be employed, or the visual display may take the form of one or more computer driven screens or monitors.

As shown in FIGS. 1 and 2, a printed circuit board 21 mounts the six LEDs 20 in two parallel linear arrays, with the LEDs disposed in three juxtaposed pairs, with the LEDs in each pair disposed on opposite sides of a slot 17 formed in the circuit board 21. The circuit board 21 includes control circuitry to control illumination of the LEDs 20, as described hereinafter. In a particularly preferred embodiment of the present invention, the face plate 14 is black in color and the LEDs 20 include filters so as to emit red colored visible light, increasing the contrast of the LEDs 20 and the face plate 14 to increase the visibility of the visual display created thereby. It will be appreciated that any light source of suitable size, color, and intensity may be used, and further that the light source need not necessarily be associated with the face plate 14, but may be located elsewhere. Thus, in the context of this disclosure, the term "visual display" is not limited to a visual pattern or display disposed on or adjacent to the face plate 14.

As shown in FIG. 1, the coin acceptor 10 includes a plastic housing 22 mounted to the underside of the LED circuit board 21. The housing 22 includes a pair of opposed spaced side walls 24 and 26 interconnected by a pair of opposed spaced end walls, one of which is illustrated at 30. The top surfaces of the housing walls 24, 26, and 30 define a top opening sized and configured to accommodate drop of a coin or token 18 therethrough. A pair of mounting walls 32 and 34 extend laterally from the top end of the housing 22 and serve to mount the housing 22 to the surface 12, with the top housing opening aligned with the slots 16 and 17. In operation, a token 18 deposited into the slot 16 will pass through the slot 17 and through the drop path disposed within the housing 22. The coin acceptors 10 preferably connect with chutes and a conventional drop box as disclosed in U.S. Pat. No. 5,112,060; or to a return chute which directs dropped tokens to the dealer chip tray, as disclosed in U.S. Pat. No. 5,377,994. The entire disclosures of U.S. Pat. Nos. 5,112,060 and 5,377,994 are hereby incorporated by reference herein. The mounting walls 32 and 34 also underlie and support the LED circuit board 21 when the housing 22 and the LED board 21 are mounted to the table surface 12. As shown, the circuit board 21 is mounted to the mounting walls 32 and 34, with the slot 16 of the face plate and the slot 17 disposed in alignment, and with the openings 19 of the face plate 14 aligned with the LEDs 20, so that each of the LEDs 20 extends through its corresponding face plate opening 19. A plurality of screws 13 (FIG. 2) may be employed to secure the face plate 14 in position.

As shown in FIG. 1, the side walls 24 and 26 include aligned upper optical openings 36 and lower optical openings 38. The side wall 26 also includes a generally central actuator opening 40 dimensioned and disposed to receive a plunger or shaft 60 of a solenoid 58 for limited reciprocal linear movement therethrough. Hollow plastic mounting pins 42 and 44 extend outwardly from outer surfaces of the housing walls 24 and 26, respectively. The pins 42 extend outwardly from the wall 24 and secure a main printed circuit board 46 thereto. The pins 44 extend from the wall 26 and secure an optical transmitter circuit board 52 thereto. An upper optical receiver 48 and a lower optical receiver 50, mounted in vertically spaced relation to an inside surface of the main printed circuit board 46, are enclosed within the hollow mounting pins 42. An upper optical transmitter 54 and a lower optical transmitter 56, mounted in vertically spaced relation to the inside surface of the transmitter board 52, are enclosed within the hollow mounting pins 44.

Thus, the hollow upper tubes 42 and 44 and the aligned upper openings 36 establish an upper optical path from the transmitter 54 to the receiver 48. Similarly, the lower tubes 42 and 44 and the aligned lower openings 38 establish a lower optical path from the transmitter 56 to the receiver 50. Optionally, the main board 46 may also be secured to the support wall 32 and the transmitter board 52 may be mounted to the support wall 34 for additional support.

The solenoid actuator 58 extends partially through and is mounted to the circuit board 52, with the plunger 60 of the solenoid 58 disposed through the opening 40 in the housing wall 26. A suitable actuator for use in the preferred embodiment of the present invention is available under the designation of Model 1952020231, manufactured by Lucas Co., and including a shaft 60, a spring 62, and an O-ring 64. When the coil of the actuator 58 is de-energized, the spring 62 biases the shaft 60 to the illustrated extended position, preventing the token 18 from dropping through the drop path in the housing 22, and maintaining the upper portion of the token 18 in a visible position above the face plate 14. In this position of the token 18, a casino dealer can visually verify that the correct denomination wager has been placed. Upon the application of electrical current to the coils of the solenoid 58, the shaft 60 retracts against the bias of the spring 62 and allows the token 18 to fall by virtue of gravity through the drop path defined between the housing walls 24 and 26. The use of a solenoid in conjunction with upper and lower optical sensors to control a coin acceptor associated with a progressive jackpot feature of a live casino table game in this manner is conventional. However, the prior art coin acceptors which employ a solenoid in conjunction with upper and lower optical sensors utilize only a single light source associated with each coin acceptor to indicate wager acceptance. In this prior art device, the associated indicating light illuminates to indicate wager acceptance and turns off upon manual reset after each hand.

Figure 4:
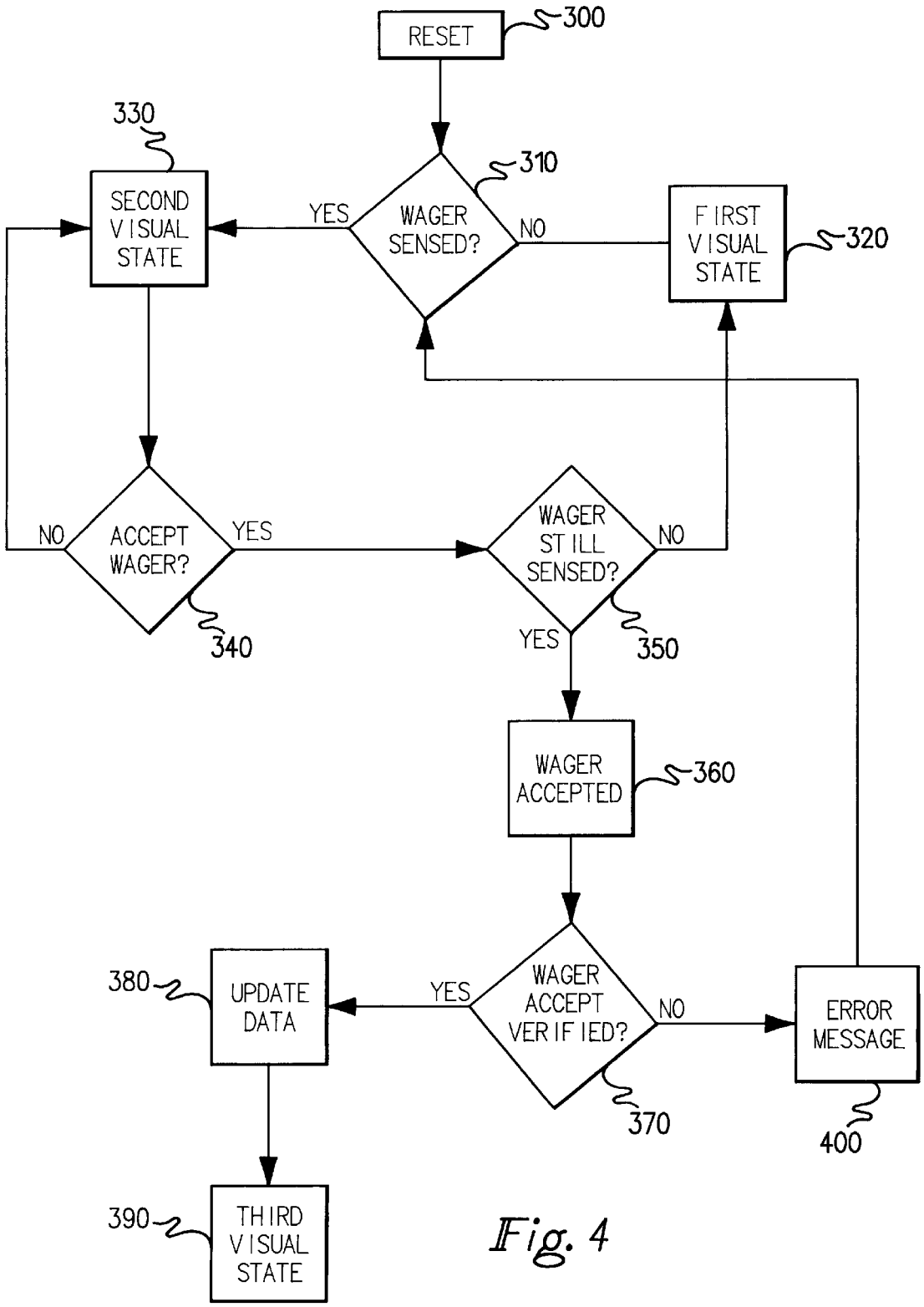
FIG. 4 depicts a flow chart illustrating the steps of operation of a coin acceptor according to the preferred embodiment of the present invention employed in connection with apparatus for including a progressive jackpot component in a live casino table card game.

FIG. 4 illustrates a flow chart of the steps of operation of the coin acceptor 10 of the present invention. Initially, the coin acceptor is disposed in a RESET condition 300 by dealer activation of a reset switch in the manner described in U.S. Pat. No. 5,078,405. If no wager is sensed by the upper optical pair 48, 54 (FIG. 1) at step 310, a first visual state is created at step 320. In the preferred embodiment of the invention, the first visual state corresponds to an invitation or attract mode in which the LEDs 20 sequentially flash to create a traveling light pattern around the slot 16 (FIG. 2). When a wager is sensed at step 310, corresponding to placement of a token 18 into the slot 16, causing obstruction of the path between the upper optical pair 48, 54, a second visual state is created at step 330, and the coin acceptor waits to receive an ACCEPT WAGER command 340. The second visual state corresponds to simultaneous flashing of all of the LEDs 20. Until the ACCEPT WAGER command 340 is received, the second visual state 330 is maintained. When the ACCEPT WAGER command 340 is received, and a wager is still sensed 350 (the token 18 has not been withdrawn by a player), the wager is accepted at step 360, by activation of the solenoid actuator 58 upon dealer activation of a lockout switch, allowing the token 18 to fall between and momentarily interrupt the optical path between the lower optical pair 56, 50. Thereafter, the acceptance of the wager is verified at step 370 as having actually been accepted by the coin acceptor in response to the ACCEPT WAGER command. Data within a microprocessor is then updated at step 380 to indicate that a wager has been placed and accepted, and a third visual state is displayed at step 390. The third visual state corresponds to constant illumination of all of the LEDs 20. If the wager has not been verified due to some anomaly, an error message is sent at step 400, causing a return to the first visual state 320. Alternatively, an error condition might activate a fourth visual state and/or an audible alarm.

Figure 5:
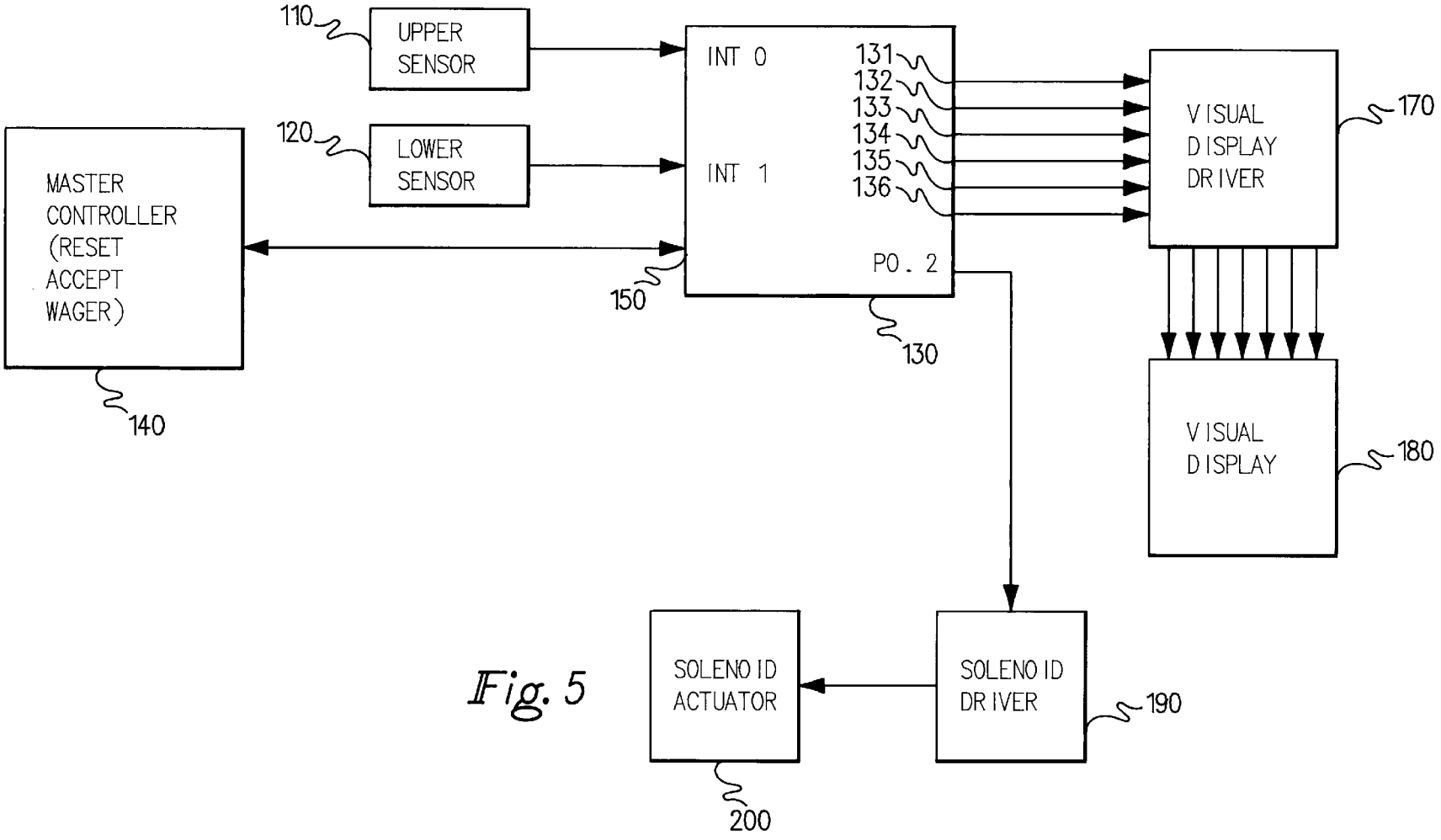
FIG. 5 illustrates a block diagram showing the electronic components of the coin acceptor according to a preferred embodiment of the present invention employed in connection with apparatus for including a progressive jackpot component in a live casino table card game.

FIG. 5 illustrates a block diagram depicting an example preferred implementation of the electronic components of the coin acceptor 10. The upper optical transmitter 54 and the upper optical receiver 48 form an upper sensor 110. The upper sensor 110 detects the presence of a token 18 disposed in the slot 16 and resting on the solenoid shaft 60. In other words, the upper sensor 110 comprises a means for sensing the placement of a wager. The lower optical transmitter 56 and the lower optical receiver 50 form a lower sensor 120. The lower sensor 120 detects passage of a token 18 through the drop path between the walls 24 and 26 of the housing 22, after retraction of the solenoid shaft 60. The lower sensor 120 thus comprises a means for verifying acceptance of a wager by the coin acceptor 10. The output of the upper sensor 110 output connects to the INT 0 pin of a microcontroller or microprocessor 130. The output of the lower sensor 120 connects to the INT 1 pin of the microcontroller 130. A Master Controller 140 connects to a bidirectional communications port 150 of the microcontroller 130 and selectively transmits a RESET signal and an ACCEPT WAGER signal to the microcontroller 130. In a preferred embodiment of the present invention, a casino dealer manually activates the RESET and ACCEPT WAGER signals by depressing corresponding buttons or keys on a manual control panel (not shown), in the manner described in U.S. Pat. No. 5,078,405. The microcontroller 130 includes output pins 131, 132, 133, 134, 135 and 136 connected to a visual display driver 170, which, in turn, connects to a visual display 180. In the embodiment shown herein, the visual display 180 comprises the LEDs 20 located adjacent the face plate 14 of the coin acceptor 10. A pin PO.2 of the microcontroller 130 connects to a solenoid driver 190, which connects to the solenoid actuator represented schematically as 200, and which physically comprises the solenoid actuator 58, the solenoid shaft 60, the spring 62 and the O-ring 64.

Figure 6:
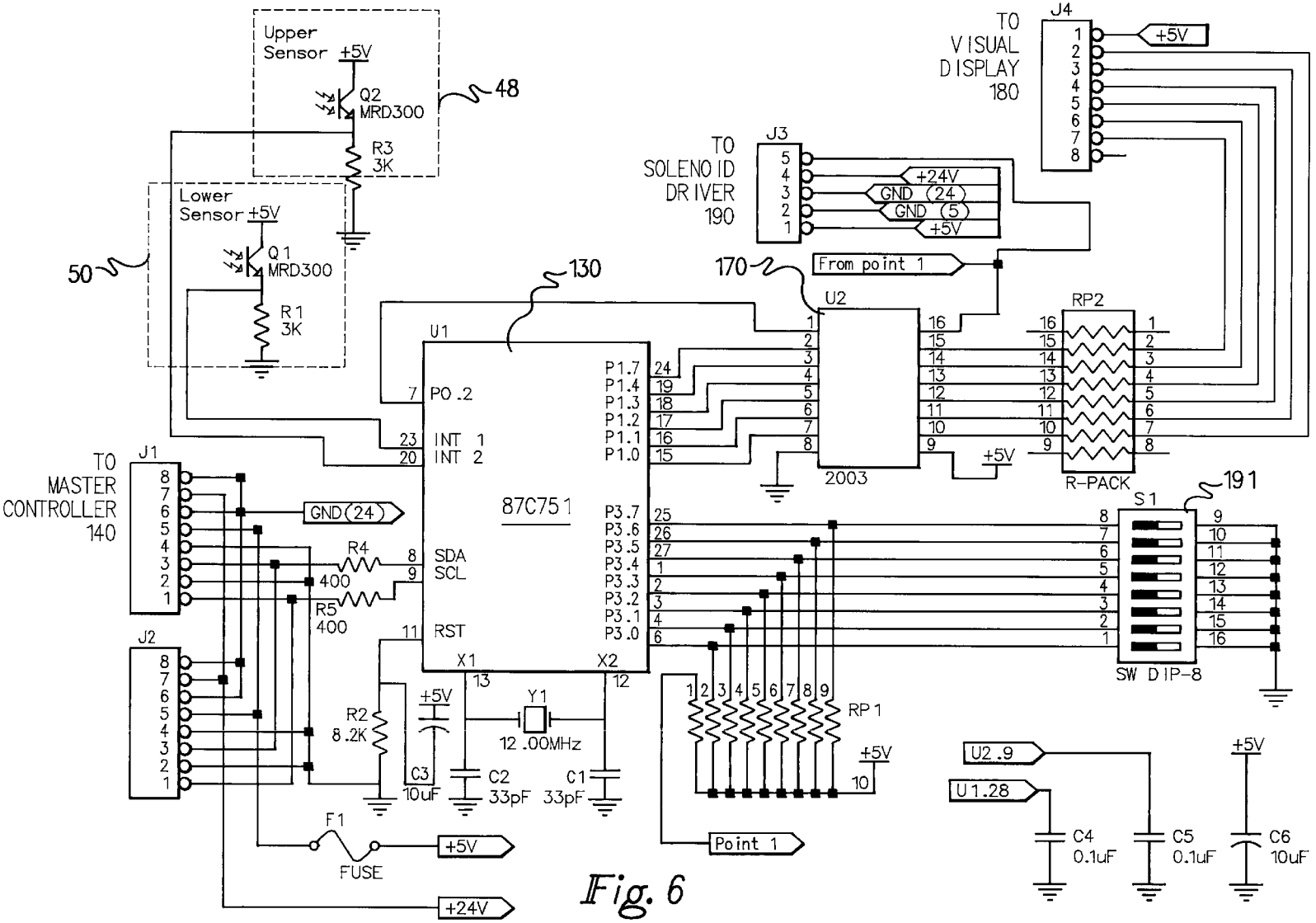
FIG. 6 depicts a schematic diagram of the electronic components of the coin acceptor according to the preferred embodiment of the present invention employed in connection with apparatus for including a progressive jackpot component in a live casino table card game.

FIG. 6 depicts an example preferred electrical schematic diagram illustrating the constructional details of the electrical components of the coin acceptor 10 according to the preferred embodiment of the present invention.

With reference to FIGS. 1, 5, and 6, in operation, the upper receiver 48 initially receives energy from the upper transmitter 54, thus causing the upper sensor 110 to send a high signal to the INT O pin of the microprocessor 130. Also, the lower receiver 56 receives energy from the lower transmitter 50, thus causing the lower sensor 120 to send a high signal to the INT 1 pin of the microprocessor 130. In this mode, the microprocessor 130 operates in a pre-programmed background subroutine which causes the visual display 180 to display the first visual state 320. In the preferred embodiment of the present invention, the microcontroller 130 sequentially controls the pins 131 through 136 from a low to high to low state to make each of the LEDs 20 flash in a sequential pattern around the face plate 14 to display the first visual state. The first visual state indicates that a player has not yet placed a token 18 in the slot 16 of the coin acceptor 10. When a player places a token 18 into the slot 16, the token 18 interrupts the upper optical path, causing the upper sensor 110 signal to INT O to go low. When this occurs, the microprocessor 130 services the interrupt by entering into a second pre-programmed subroutine in which the following two events occur. First, the microcontroller 130 drives the pins 131 through 136 in a second visual pattern or visual state 330, visually distinct from the first visual pattern or visual state 320. In the preferred embodiment of the present invention the microprocessor 130 drives the pins 131 through 136 from low to high to low, simultaneously, so that lights 20 flash simultaneously at the face plate 14. This second visual state 330 indicates that a player has placed a token 18 in the slot 16 of the coin acceptor 10. Second, the microcontroller 130 waits for an ACCEPT WAGER command from the Master Controller 140 via the bidirectional line to the communication port 150.

When the microprocessor 130 receives the ACCEPT WAGER command, and the token 18 continues to interrupt the upper optical path (i.e., the token 18 has not been removed by the player and the INT O line is still low), the microprocessor 130 goes into a third pre-programmed subroutine in which several events occur. First, the pin PO.2 goes high to activate the solenoid driver 190, which in turn energizes the solenoid 200 to retract the solenoid shaft 60 and allow the token 18 to pass through the drop path in the housing 22. The solenoid shaft 60 remains retracted for the duration that the solenoid 200 remains energized, preferably for a relatively brief interval just sufficient to allow token drop in order to minimize heating of the solenoid coil. Second, the microprocessor 130 starts counting for a pre-programmed time, to receive an INT 1 signal change. In the preferred embodiment, the microprocessor counts for 250 milliseconds. If the signal on INT 1 of the microprocessor does not change within 250 milliseconds, the count times out and the pin 7 goes low to de-energize the solenoid 200, causing the shaft 60 to spring back into a position blocking the drop path, as shown in FIG. 1. Third, the passing of the token 18 through the drop path in the housing 22 breaks the lower optical path between the transmitter 56 and the receiver 50, causing the signal from the lower sensor 120 to the INT 1 pin of the microprocessor 130 to go low, because the lower receiver 50 no longer receives energy from the lower transmitter 56.

When INT 1 goes low, the microprocessor 130 goes into another subroutine in which it waits for a selected count for the INT 1 pin to go high again (representing that the token 18 has completely passed through the lower optical path). If this does not occur, the count will time-out and the microprocessor will send an error message. An error might occur upon passage of an unauthorized over or undersize object past the lower sensor, or upon reverse movement of a token as if on a string. If the token 18 clears the optical path within the allotted interval, then the microprocessor will enter into a fourth subroutine in which the microprocessor: (a) stores an ACCEPT WAGER signal to increment an internal count and for sending back to the Master Controller 140 for use of that data; and (b) drives the pins 131 through 136 in a third visual pattern or visual state 390 visually distinct from the first and second visual patterns or visual states. The third visual state 390 indicates that the wager has been accepted and the player is participating in the progressive jackpot component of the game. In the preferred embodiment of the present invention, the microcontroller 130 causes all of the pins 131 through 136 to go high and to stay high until the microprocessor 130 receives a RESET signal 300. In the third visual state 390, each of the LEDs 20 remain on continuously. At the end of play of a hand, the dealer, or some other external or internal source, sends a RESET command 300 which resets the microprocessor 130 to its initial background state during which it drives the visual display 180 in the first visual pattern 320 and waits for the first or second interrupts described above.

The dip switch 191 shown in FIG. 6 allows configuration of the multi-state visual indicator system for use with several different types of coin acceptors: (1) solenoid gravity coin slot (the illustrated and described preferred embodiment); (2) a so-called "hockey puck" coin acceptor which comprises a circular zone for token placement including a sensor for detection of token placement; and (3) a gravity coin slot without a solenoid.

Figure 7:
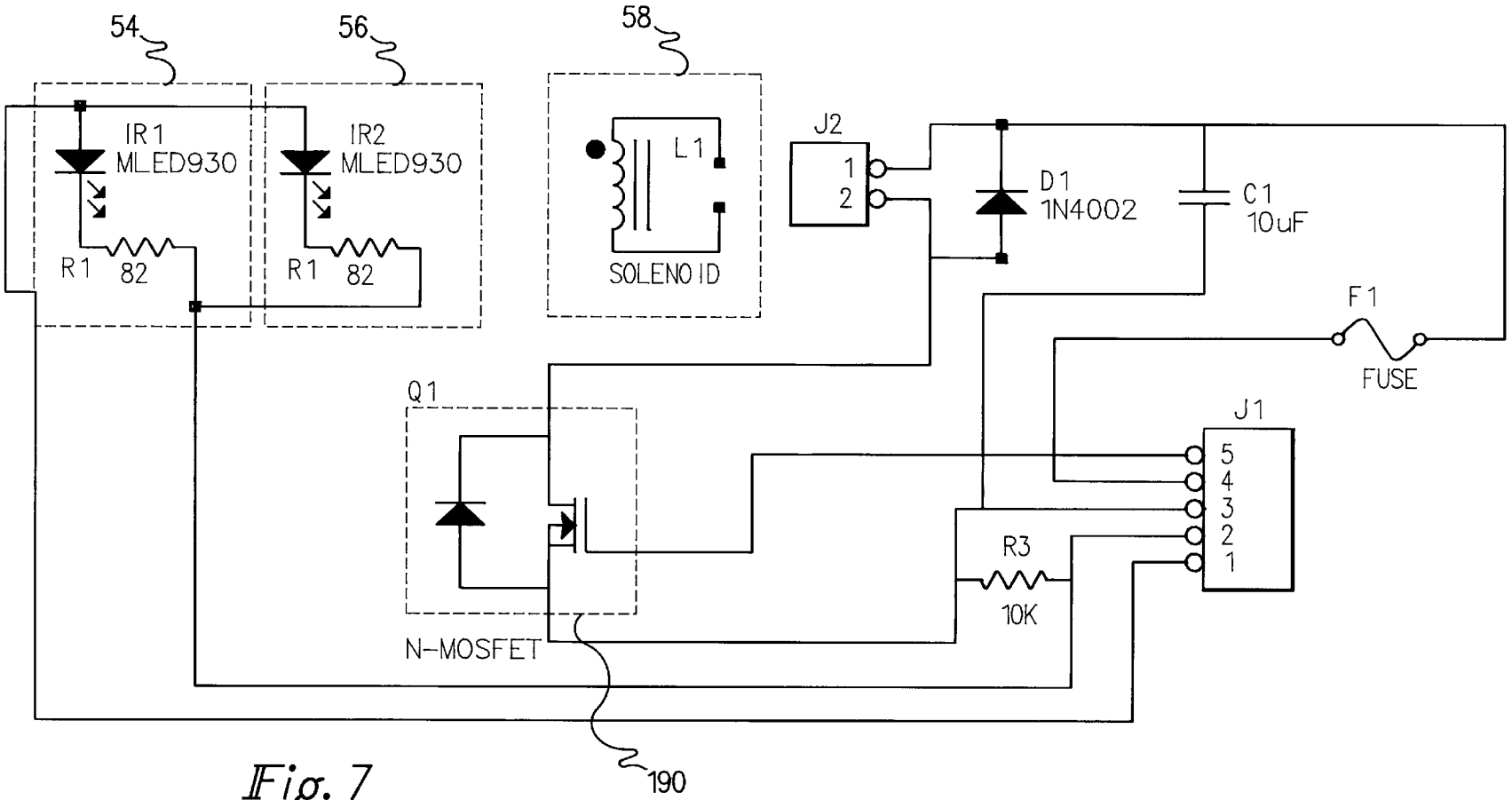
FIG. 7 illustrates a schematic diagram of a solenoid driver circuit of the coin acceptor according to the preferred embodiment of the present invention.

FIG. 7 illustrates a schematic diagram showing a preferred solenoid driver circuit and also illustrating the optical transmitters 54 and 56.

Figure 8:
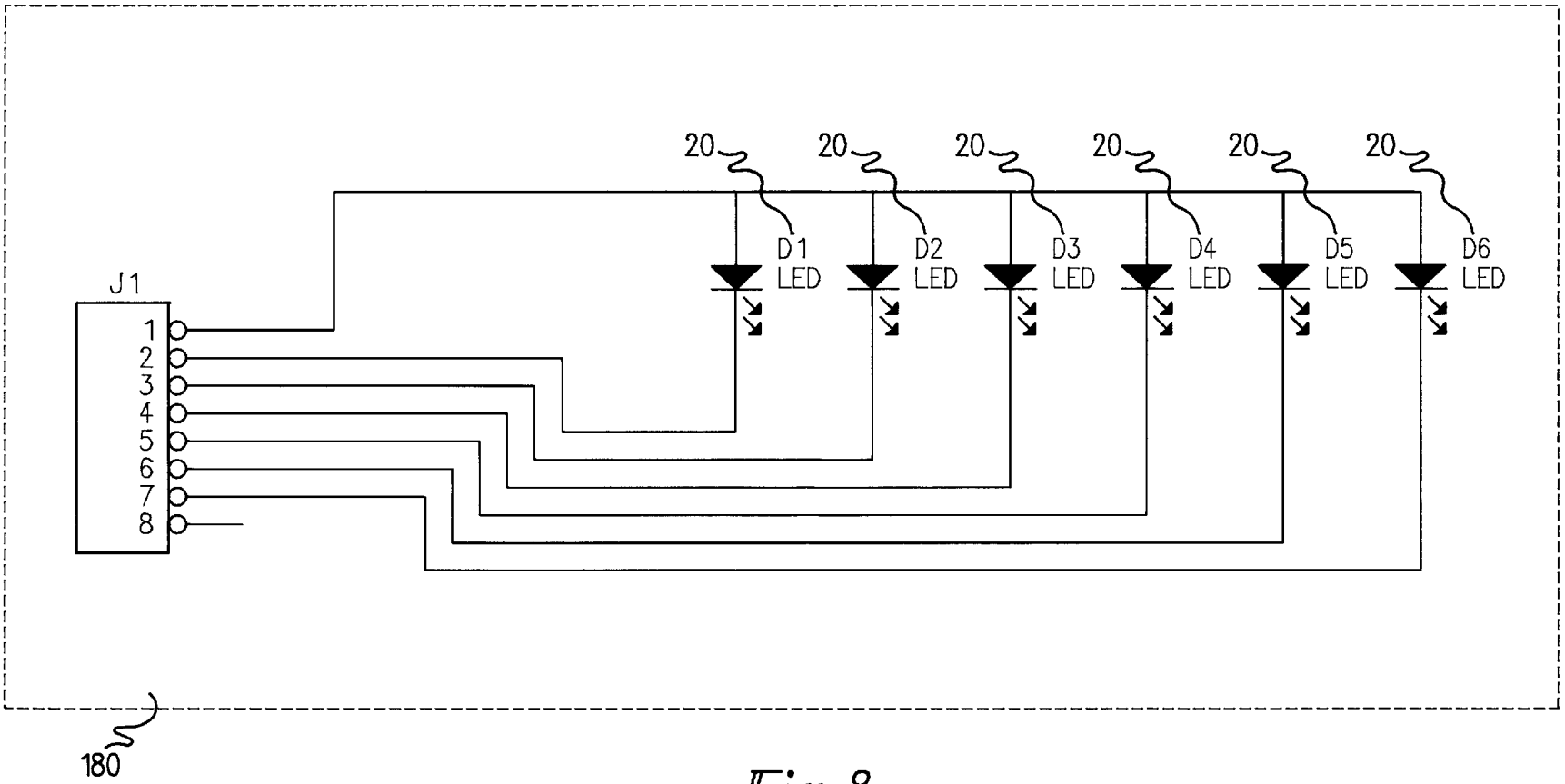
FIG. 8 depicts a schematic diagram of a visual display circuit of the coin acceptor according to the preferred embodiment of the present invention.

FIG. 8 illustrates a schematic diagram showing the visual display 180, which in the preferred embodiment comprises the six LEDs 20.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

We claim:

1. A coin acceptor including a multi-state visual display, comprising:

an acceptor for receiving a coin;

a first sensor operably connected with said acceptor for sensing placement of a coin into said acceptor;

a second sensor operably connected with said acceptor for sensing acceptance of a coin;

a microprocessor operably connected to said first and second sensors; and a visual display operatively connected to said first and second sensors and said microprocessor and operative, pursuant to control instructions from said microprocessor, to display a first visual state corresponding to absence of a coin from said acceptor, a second visual state corresponding to placement of a coin into said acceptor, and a third visual state corresponding to acceptance of a coin.

2. The coin acceptor of claim 1, wherein said visual display comprises a plurality of light sources disposed in a predetermined pattern.

3. The coin acceptor of claim 2, wherein at least one of said visual states corresponds to simultaneous flashing of said light sources.

4. The coin acceptor of claim 2, wherein at least one of said visual states corresponds to sequential flashing of said light sources.

5. The coin acceptor of claim 1, wherein said coin acceptor is associated with a gambling device for detecting wagers.

6. The coin acceptor of claim 1, wherein said acceptor includes a slot dimensioned for insertion of a coin.

7. The coin acceptor of claim 1, wherein said acceptor includes a location dimensioned for placement of a coin and said first sensor detects a coin placed in said location.

8. A gambling device including a coin acceptor having a multi-state visual display, comprising:

an acceptor for receiving a coin;

a first sensor operably connected with said acceptor for sensing placement of a wager into said acceptor;

a second sensor operably connected with said acceptor for sensing acceptance of a wager;

a microprocessor operably connected to said first and second sensors; and a visual display operatively connected to said first and second sensors and said microprocessor and operative, pursuant to control instructions from said microprocessor, to display a first visual state corresponding to absence of a wager from said acceptor, a second visual state corresponding to placement of a wager into said acceptor, and a third visual state corresponding to acceptance of a wager.

9. The gambling device of claim 8 further comprising one of said coin acceptors disposed at each player location of a live casino card gaming table and operatively connected to a jackpot component to allow optional player participation in said jackpot component by placement of a wager in the associated coin acceptor.

10. The gambling device of claim 8, wherein said visual display comprises a plurality of light sources disposed in a predetermined pattern.

11. The gambling device of claim 10, wherein at least one of said visual states corresponds to simultaneous flashing of said light sources.

12. The gambling device of claim 10, wherein at least one of said visual states corresponds to sequential flashing of said light sources.

13. A method of indicating the condition of a coin acceptor, comprising the steps of:

providing an acceptor dimensioned to receive a coin;

providing a first sensor operably connected with said acceptor for sensing placement of a coin into said acceptor;

providing a second sensor operably connected with said acceptor for sensing acceptance of a coin;

providing a microprocessor operably connected to said first and second sensors;

providing a visual display operatively connected to said first and second sensors and said microprocessor; and displaying on said visual display pursuant to control instructions from said microprocessor a first visual state corresponding to absence of a coin from said acceptor, a second visual state corresponding to placement of a coin into said acceptor, and a third visual state corresponding to acceptance of a coin.

14. The method of claim 13, wherein said step of providing a visual display includes the step of providing a plurality of light sources.

15. The method of claim 14, wherein said step of displaying at least three different visual states includes the step of simultaneously flashing said light sources.

16. The method of claim 14, wherein said step of displaying at least three different visual states includes the step of sequentially flashing said light sources.

* * * * *